US006921373B1

(12) United States Patent
Bernstein

(10) Patent No.: US 6,921,373 B1
(45) Date of Patent: Jul. 26, 2005

(54) METHOD AND APPARATUS FOR A PERIPHERAL CIRCULATION ENHANCEMENT SYSTEM

(76) Inventor: Myron Z. Bernstein, 10 Scotch Mist Ct., Potomac, MD (US) 20854

( * ) Notice: Subject to any disclaimer, the term of this patent is extended or adjusted under 35 U.S.C. 154(b) by 227 days.

(21) Appl. No.: 10/292,217

(22) Filed: Nov. 13, 2002

(51) Int. Cl.[7] ..... A61H 9/00

(52) U.S. Cl. ..... 601/151; 601/150; 601/152; 128/DIG. 20

(58) Field of Search ..... 601/148, 149, 601/150, 151, 152, 33, 34; 602/13; 128/DIG. 20; 606/201, 202, 203

(56) References Cited

U.S. PATENT DOCUMENTS 4,077,402 A * 3/1978 Benjamin et al. ..... 601/150
4,343,302 A * 8/1982 Dillon ..... 601/152
5,458,562 A * 10/1995 Cooper ..... 601/151
5,514,079 A 5/1996 Dillon
5,674,262 A 10/1997 Tumey

* cited by examiner

*Primary Examiner*—Gregory L. Huson
*Assistant Examiner*—Quang D. Thanh
(74) *Attorney, Agent, or Firm*—Joseph H. Taddeo

(57) ABSTRACT

The present invention provides an apparatus and method for enhancing the circulation to an extremity of a patient. During the compression phase, the extremity is compressed, pushing out superficial edema as well as emptying the superficial venous tree. The compression cycle is timed to begin at or slightly after the "P" segment of the heartbeat. Air slowly fills a boot so that it reaches maximum capacity just as the heart reaches the diastolic phase in the heartbeat. Since the heart is at its lowest pressure, there is little resistance from the heart, making it easier for the compression of the extremity to push fluids out into the venous structures carrying them back to the heart. When the heart reaches the next full beat, the extremity is void of some of the fluid, forcing from the heart fresh oxygenated blood into the extremity, thereby promoting circulation through the heart.

37 Claims, 7 Drawing Sheets

METHOD AND APPARATUS FOR A PERIPHERAL CIRCULATION ENHANCEMENT SYSTEM

FIELD OF INVENTION

The present invention relates primarily to a peripheral enhancing circulation system, and more particularly to a method and apparatus for improving and enhancing the circulation of fresh oxygenated blood to a patient's extremity.

BACKGROUND OF THE INVENTION

Circulation enhancement boots have been known in the art for some period of time. One such boot is known as a "Circulator Boot," has been available for several years. This boot is used to compress an extremity between 1–3 milliseconds after the QRS segment of the heart beat. By doing so, the superficial fluid in the leg is pumped back into the circulatory path. The pressure from the heart is at its lowest point when compression occurs. Therefore, by squeezing fluids back to the heart it not only aids in increasing heart flow and profusion to the heart; but also, by emptying the superficial veins and fluid in the leg, the pressure from the heart helps to push fresh blood into the extremity.

The following prior art discloses the various aspects in the design and use of the peripheral circulation enhancement system.

U.S. Pat. No. 5,458,562, granted Oct. 17, 1995, to G. F. Cooper, discloses an apparatus where blood circulation in an injured human foot is involuntarily promoted in a vacuum over-pressure cycle and in synchronism with the heart's systolic and diastolic pressure pulsations. In a preferred embodiment the circulation apparatus comprises an air tight boot contoured to the injured foot, a pulsed synchronized tourniquet for inhibiting blood flow to the injured foot during an over-pressure cycle and a control circuit which monitors the heart's systolic and diastolic pressure pulsations and provides electrical control signals to the pressure modulator to assure that the over-pressure and vacuum pulses are cyclic and in synchronism with the heart's systolic and diastolic pressure pulsations.

U.S. Pat. No. 5,514,079, granted May 7, 1996, to R. S. Dillon, teaches of a method and apparatus for improving the circulation of blood through a patient's heart and extremity. The method comprises applying external positive regional pressure on an extremity synchronously with the patient's heartbeat. An adjustable timing cycle is initiated at the QRS complex of the arterial pulse cycle. The timing cycle is based on an average time period between QRS complexes, which is calculated from a measurement of several successive QRS complexes in the patient's heart rate. Pressure pulses are applied in the end-diastolic portion of the arterial pulse cycle to reinforce the pulse that forces blood into the extremity. The pressure is then relieved prior to the next projected QRS complex to enable the next pulse to enter the extremity without undue obstruction, thereby promoting circulation of blood through the extremity. To promote circulation of blood through the heart, compression of the extremity is released shortly before the next projected QRS complex.

U.S. Pat. No. 5,674,262, granted Oct. 7, 1997, to D. M. Tumey, discloses a device and method for stimulating blood flow velocity in a leg of the body for the prevention of Deep Vein Thrombosis in an effective and relatively painless manner which, in one case, includes an apparatus for compressing a foot in a manner to drive a substantial amount of blood from veins of the foot therein into blood vessels of the leg and an apparatus operably associated with the compressing apparatus for electrically stimulating leg muscles as the driven blood from the foot passes through, such that the muscles drivingly enhance blood flow velocity.

With reference to Dillon, the heart monitor for Circulator Boot (CB) functions by utilizing the QRS segment of the heart beat which is ventricular contraction. It functions by triggering the compression at about 1–3 milliseconds after diastole. The CB uses a hard fiberglass shell with a specialized plastic air bag inside the shell. There is a Velcro sleeve around the extremity to control the outward expansion of the plastic air bag. This forces the plastic airbag to force its pressure inward. Also, the CB controller is mounted on top of the fiberglass housing. An "O" ring hooks to the underside of the valve directly. When the heart monitor opens the valve, a quick surge of air is forced into the plastic bag, and the valve releases to vent the entrapped air. Thus, the cycle is very rapid and in about one second the air compresses the extremity.

What is needed is circulation enhancement system that initiates the compression cycle by sensing when the heart reaches the "P" segment, and then slowly increases the applied pressure, compressing the extremity, until the back pressure from the heart is near the lowest point, thereby relieving the pressure while anticipating the next cycle. In this regard, the present invention fulfils this need.

It is therefore an object of the present invention to provide a peripheral circulation enhancement system that utilizes a heart monitor to observe a patient's heartbeat.

It is another object of the present invention to provide a peripheral circulation enhancement system that utilizes a heart monitor to observe a patient's heartbeat to sense the "P" segment of the heart wave.

It is still another object of the present invention to provide a peripheral circulation enhancement system that utilizes a heart monitor to observe a patient's heartbeat to sense the "P" segment of the heart wave and to count every beat, every second beat or every third beat.

It is still yet another object of the present invention to provide a peripheral circulation enhancement system that utilizes a heart monitor to observe a patient's heartbeat to sense the "P" segment of the heart wave and when the selected number of beats is attained, initiate the compression cycle.

Another object of the present invention is to provide a peripheral circulation enhancement system that utilizes a heart monitor to observe a patient's heartbeat to sense the "P" segment of the heart wave and when diastole is reached, being the lowest pressure from the heart, the internal pressure within the boot is slowly decreased by allowing the entrapped air to be released to the ambient.

Still another object of the present invention is to provide a peripheral circulation enhancement system that utilizes a double wall formed boot, having an expandable spandex-like material inside and an outer membrane of a formed soft flexible plastic.

A final object of the present invention is to provide a peripheral circulation enhancement system that utilizes a controller having two flow regulators, one to control the slowly increasing volume of air entering the compression boot, and one to control the slow release of the air entrapped within the compression boot.

SUMMARY OF THE INVENTION

The present invention relates to a medical device designed to enhance circulation to the extremities of the human body. It consists of a compression boot, which is made of a two-sided poly-plastic material. The outer casing is more rigid than the inner casing. When air is pumped into the boot, the outer casing expansion is restricted, while the inner air bladder, made of a plastic-spandex like material, is allowed to expand. Therefore, the inner air bladder expands inwardly thus creating compression to the extremity.

The control box is comprised of a solenoid valve, which will open and close at a specific timing. Compressed air of about 90 psi is applied to the control box, where the solenoid valve controls its cycling between being open or closed. An adjustable pressure control valve permits the air pressure to the boot to be adjustable between 25–35 psi to maintain a constant pressure. Thus, the flow of air out of the controller to the compression boot will be less than the pressure source.

A heart monitor records the beating of the heart. Just as the heart reaches about one millisecond after the systolic pressure (P-wave), it sends a signal to the controller to energize the solenoid valve in the controller to open and allow air to enter into the compression boot. By the time the air builds up in the compression boot, the heart should be just before or nearing diastole. Therefore, the pressure against the extremity will not meet with a blood pressure resistance due to blood pressure at or near the highest or peak value. Instead the blood pressure of the body will be nearing the lowest value but not quite at the lowest value.

The present invention allows the compression of superficial fluids and compression of superficial veins to be met with less resistance from the systolic blood pressure; therefore, the fluid will be forced out of the area. It is at this point that the solenoid valve closes, allowing the compression boot to relax. At this point the heart is starting to increase pressure to reach the systolic pressure. As this occurs, the blood will be easily rammed to the extremity because the prior emptying of fluid has decreased the pressure in the extremity. Thus, the circulation of fresh oxygenated blood is enhanced to the extremity.

BRIEF DESCRIPTION OF THE DRAWINGS

A complete understanding of the invention may be obtained by reference to the accompanying drawings when taken in conjunction with the detailed description thereof and in which.

A better understanding and appreciation of these and other objects and advantages of the present invention will be obtained upon reading the following detailed description of the preferred embodiment when taken in conjunction with the accompanying drawings.

DETAILED DESCRIPTION OF THE INVENTION

Figure 1:
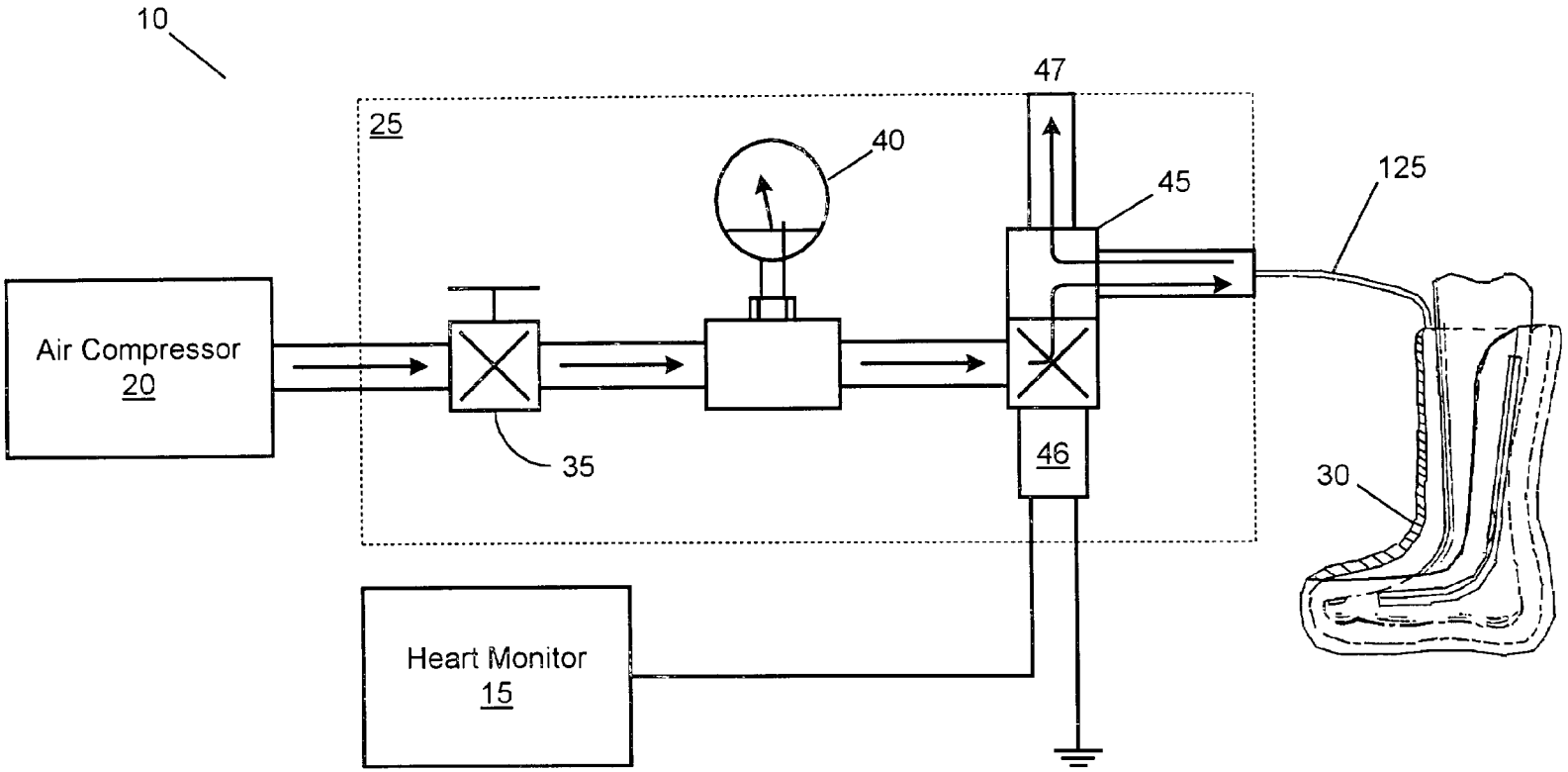
FIG. 1 is a pneumatic diagram of the preferred embodiment of the peripheral circulation enhancement system.

Referring now to the drawings and to FIG. 1, a circulation enhancement system 10 is shown that is comprised of a heart monitor 15, a source of compressed air 20, a pneumatic controller 25 and a novel circulation enhancing boot 30.

In the preferred embodiment, an oil-less and waterless air compressor 20 is used to create the air pressure necessary to operate and inflate the enhancement boot of the present invention, although other sources of pressurized air, up to 90 psi, may be used. In most cases a simple air compressor that will provide 20 to 30 psi will suffice.

The controller box 25 is connected via an inflow hookup to bring the air in from the air compressor 20. A manually operated, adjustable pneumatic pressure control valve 35, having a calibrated dial, is used to control the air pressure that is applied to the compression boot.

By observing the pressure indicator 40, the adjustable pneumatic pressure control valve 35 is set to provide preferably twenty-five psi from the control box 25 to the peripheral enhancing boot 30, although the applied pressure can typically range between twenty to thirty pounds per square inch from the control box, dependant upon the application.

Also inside the control unit 25 is preferably, a solenoid 46 operated, pneumatic 3-port air valve or valve actuator 45, which will ope waveform pulse. When the valve opens, a volume of air will be allowed to flow into the boot 30, thus filling the boot creating the compression. Upon detection of the diastolic U segment, the valve 45 closes, shutting off the supply of air to the boot, while simultaneously exhausting the entrapped air in the boot to the atmosphere, via exhaust port 47.

The novel heart monitor 15 of the present invention conditions the signal derived from the EKG waveform to actuate the pneumatic valve 45.

Figure 2:
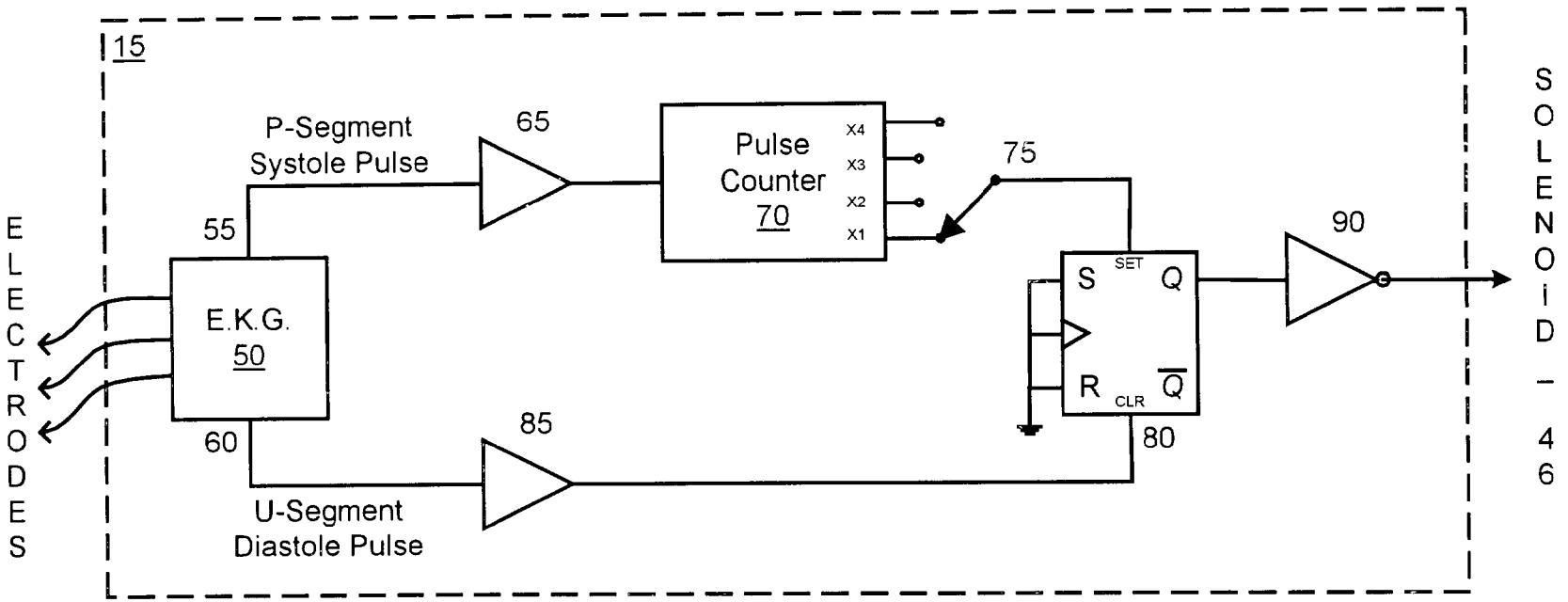
FIG. 2 is a diagrammatic representation of the heart monitor and the electronic pulse forming circuitry.

Turning now to FIG. 2, the heart monitor 15 is capable of using every beat, every other beat, every third beat, or even every fourth beat of the heart, derived from the EKG 50, to energize the solenoid 46 of valve 45 to cause the valve to open. The heart monitor generates an electrical pulse 55 that is derived from the P segment of the heartbeat, and is amplified by amplifier 65. Connected to the output of the amplifier is a pulse counter 70 that counts the first, second, third or fourth beat. A selector switch 75 is used to select the number of heartbeats comprising the boot relaxation period, where the rotary selector connects to the "set" input of RS flip-flop 80. The RS flip-flop 80 is reset by the electrical pulse 60 that is derived from the U segment of the heartbeat, which is subsequently amplified by amplifier 85. The output of flip-flop 80 connects to the input of power amplifier 90, which in turn powers the solenoid of valve 45.

Figure 3:
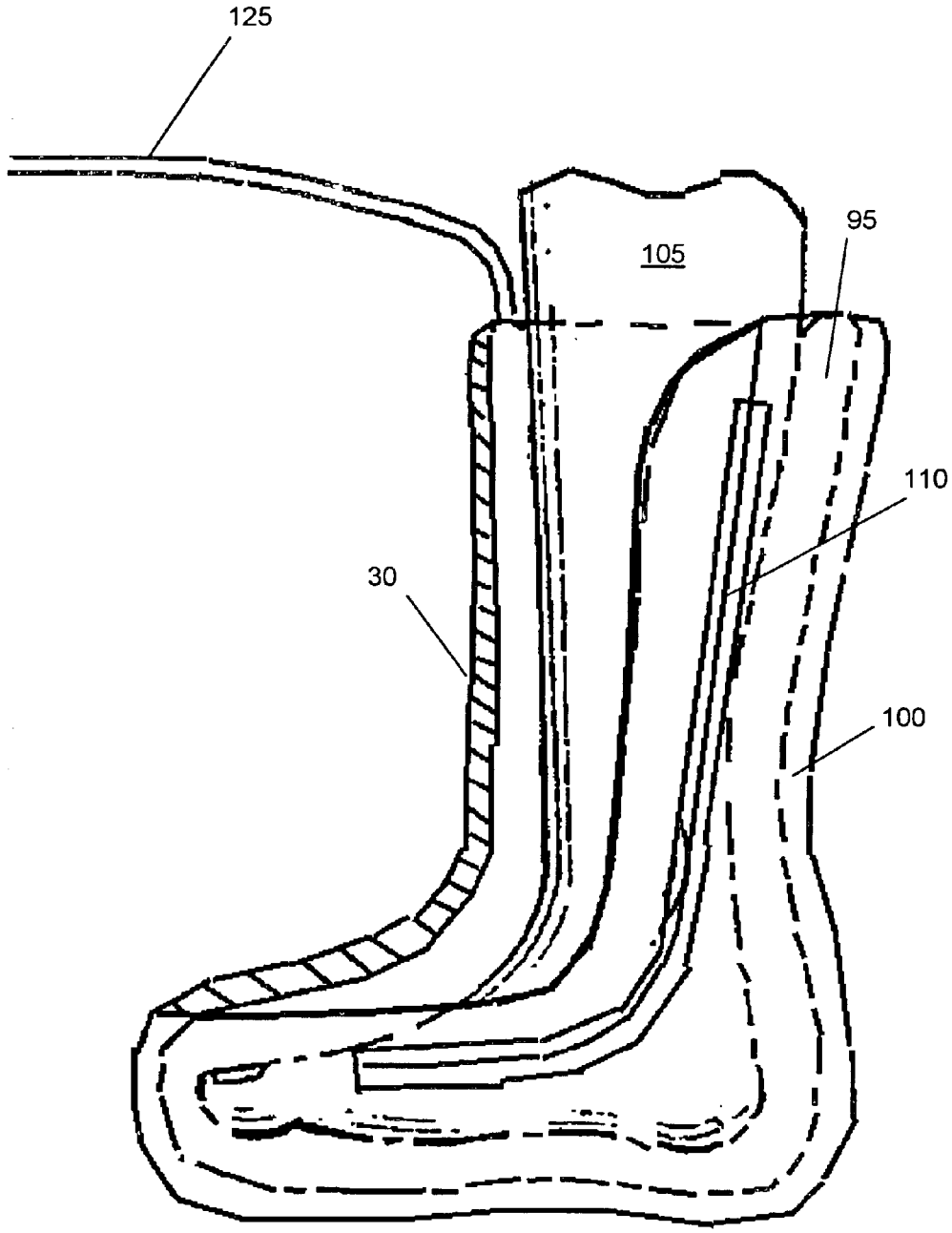
FIG. 3 is a side sectional view of the pneumatically operated and controlled boot that provides an enhanced flow of oxygenated blood to one's extremity.

There is shown in FIG. 3 the peripheral circulation-enhancing boot 30. The boot is made of two materials. An inner material 95, which is an air-tight plasicized bladder, can be fabricated of a spandex material and is the air-tight membrane that expands inward thus causing compression against the extremity 105. The outer membrane 100 is a firmer plastic coated material, which even though it is flexible, is not able to expand easily with pressure. Therefore by its very nature, it causes the air to only expand the inner lining while the outer lining acts as an expansion control. This boot 30 has a zipper 110 that can be zipped closed over an extremity 105, thereby making it easy to put on and/or take off.

Other than the wire leads from the heart monitor to the solenoid valve inside the controller box, simple plastic tubing 125 is used to carry air from the controller to the enhancement boot itself. The enhancement boot expands just so much and when the air valve is closed, the boot starts to lose the pressure thus shrinking in size. Thus, it is getting ready for the next heart beat when blood is forced into the extremity while there is no compression.

This same cycle can be repeated at every heartbeat, every other heartbeat, or the relaxation period can be extended to a plurality of heartbeats. Therefore, on one beat, fluid is pushed out of the extremity and on the next beat fluid (blood) is pushed, by the heart, back into the extremity.

Figure 4:
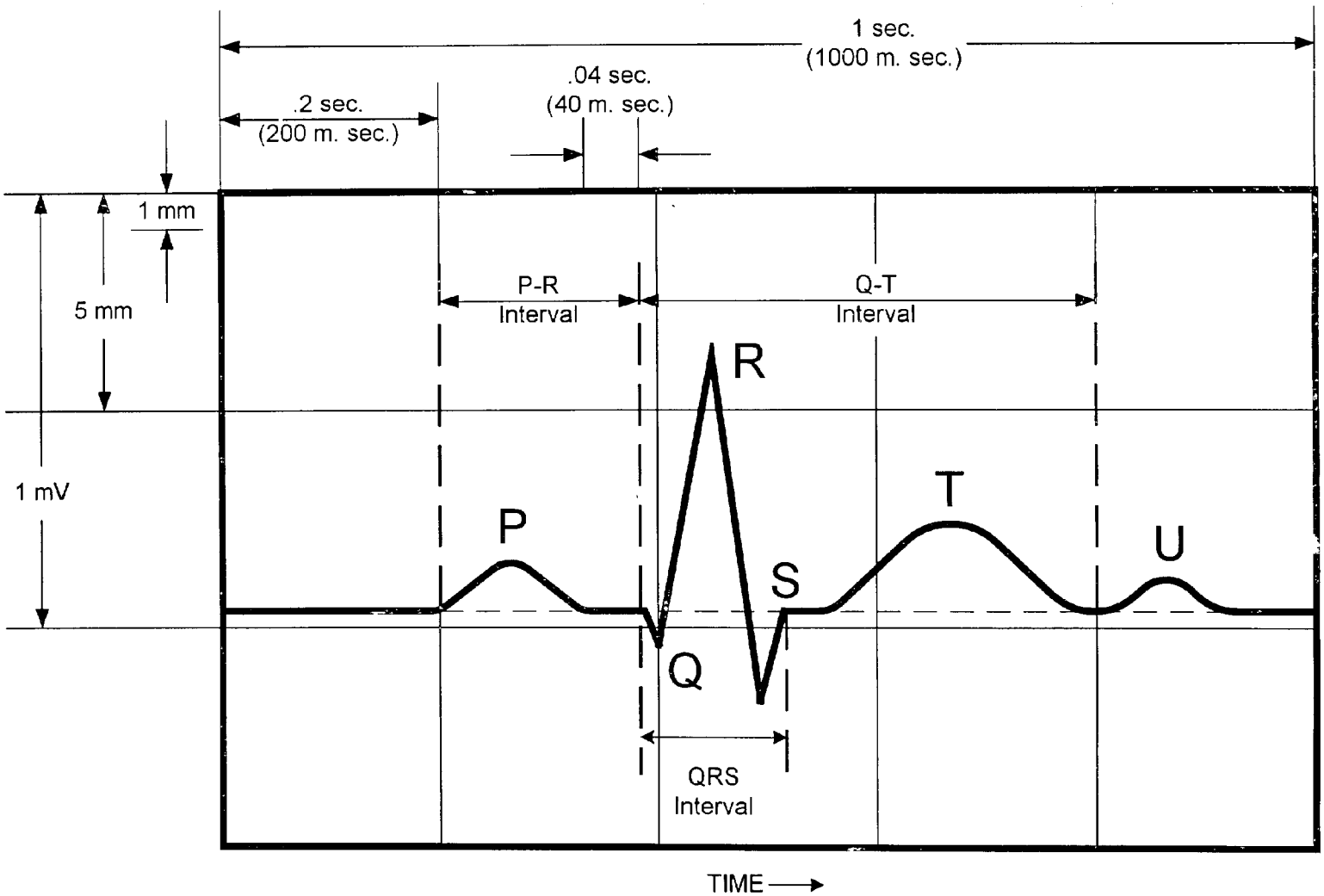
FIG. 4 is a graph showing a typical EKG waveform, showing the timing relationship of the P-segment (systole) and the U-segment (ventricular diastole).
Figure 5:
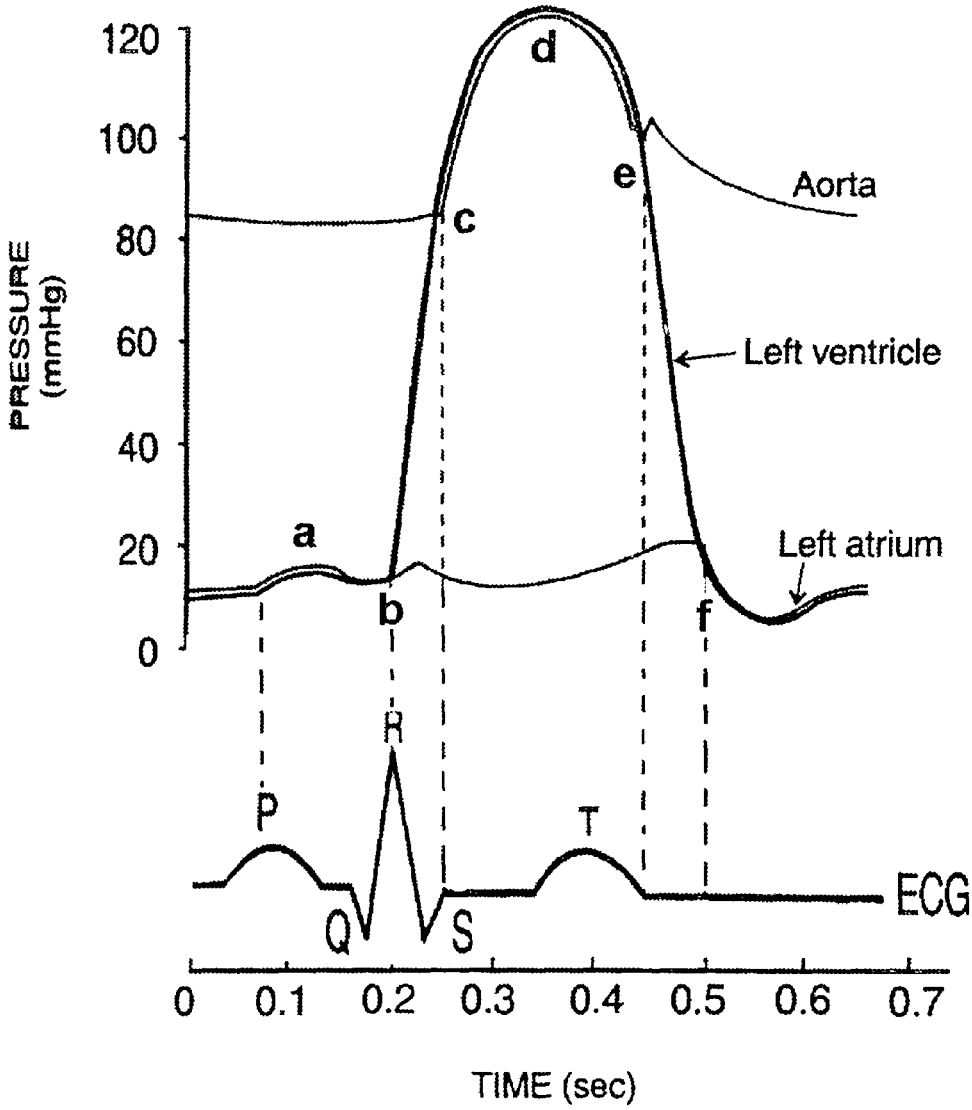
FIG. 5 is a Wigger's diagram showing a relationship between the various pressures within one's heart and the related typical EKG waveform.

Shown in FIG. 4 is a graph of a typical EKG waveform that shows the timing relationship of the P-segment (systole) and the U-segment (ventricular diastole). This invention provides a heart monitor means for sensing the P and U segments, in communication with the controller through a pneumatic valve, that is configured to open at the P segment, close with the U segment, and synchronize an air pressure of the boot to be essentially inversely proportional to a blood pressure of the encased extremity.

With reference now to there is shown Wigger's diagrams that are good for showing that the electrical activity (depolarization) recorded on an EKG actually occurs well before the actual mechanical contraction of the atria and ventricles.

The EKG shown at the bottom of the Wigger's diagram illustrates normal sinus rhythm. Atrial and ventricular contraction are shown as pressure changes in the atria, ventricles and aorta. The dotted lines have been included to correlate the time of occurring mechanical activity relative to the EKG activity.

Hence, the present invention utilizes the P segment (Auricular contraction) to start the flow of air into the boot. Therefore the boot will not reach full internal pressure or full compression until near or at diastole, which is the most desired.

Typical Operation

The heart monitor, when attached to the patient, will sense when the heart reaches the "P" segment of the beat (Auricular contraction). It then sends a signal to the control box to energize the solenoid of the pneumatic valve inside the controller. The valve opens, releasing up to 90 psi of compressed air to flow into the adjustable pneumatic pressure valve, where it reduced preferably to 30 pound per square inch into the peripheral boot wrapped around the leg. This boot has a firmer membrane on the outside that does not expand. The inner portion of the boot has a softer cloth membrane which when the air enters the inner chamber will cause the inner membrane to expand slowly and compress the extremity. By the time the inner membrane expands, the heart should have just passed ventricular contraction; therefore, the backpressure from the heart should be near the lowest point. Thus, it will be easy to empty the leg of excess fluids and the superficial veins.

Now the valve will close. At this point air will slowly start to leak out of the boot, which is what we want it to do, thereby reducing the pressure on the extremity. On the next beating of the heart, blood forced by the heart will flow into the extremity. Since the boot is no longer full, there will be no backpressure in the leg so it will make it easier for the heart to push blood into the extremity. On the next beating of the heart, the same cycle will be repeated.

Figure 6:
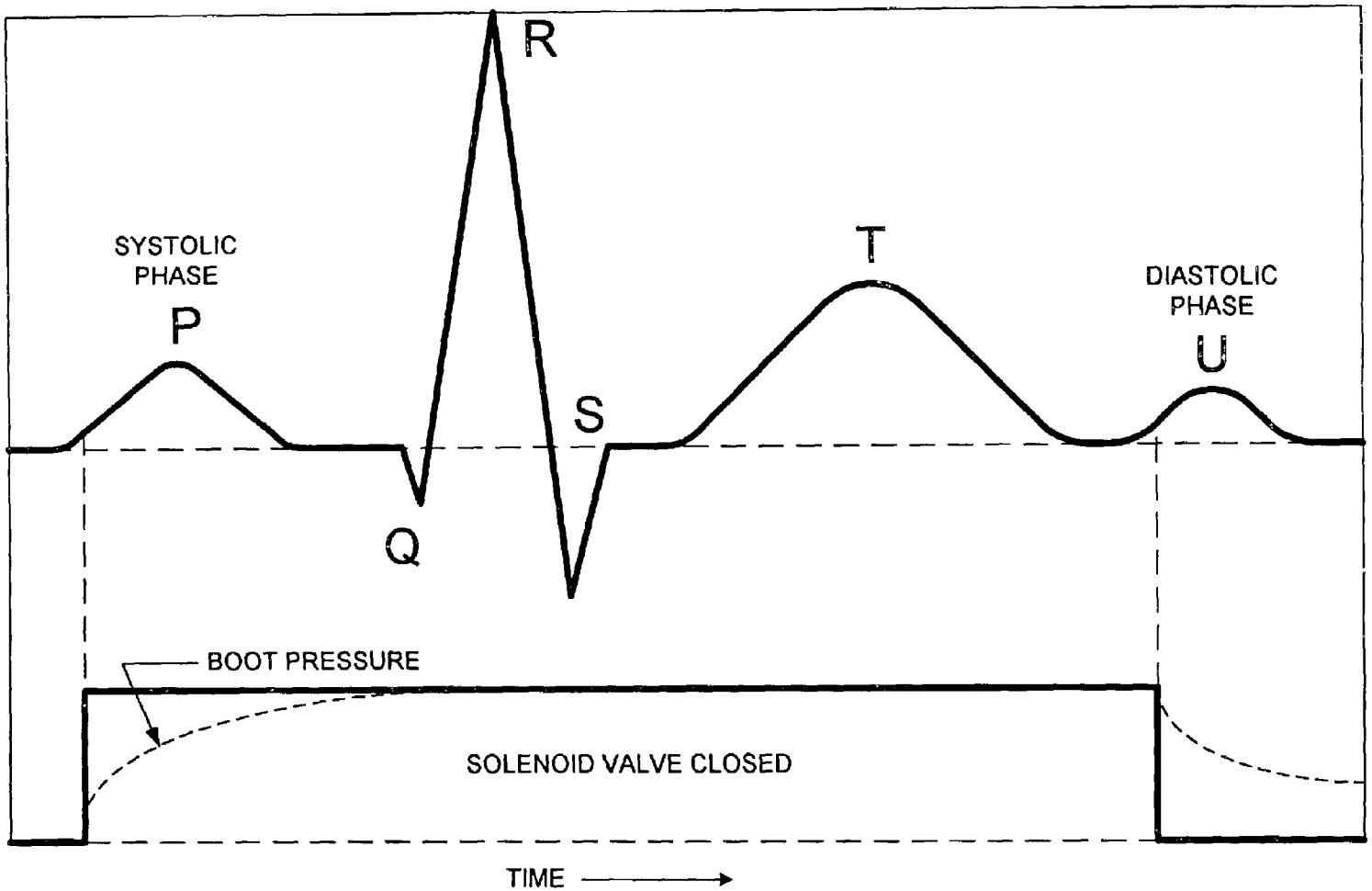
FIG. 6 is a composite graphical representation that illustrates the correlation of the operation of the solenoid valve with the waveform produced by the EKG, and also showing the relationship of the applied boot pressure.

As is shown in FIG. 6, the solenoid 46 of valve 45 is energized commencing with the P segment of the EKG, where the boot becomes pressurized. At the beginning of the U segment, where the diastolic pressure is rapidly decreasing, the solenoid of valve 45 de-energizes, depressurizing the boot by venting the entrapped air to the atmosphere.

Summarizing, the heart monitor has the capability of beating at every heartbeat, at after the second, or third or fourth heartbeat. By allowing for a variably selected period of pneumatic relaxation, the circulation enhancement system will assist in bringing fresh oxygenated blood to the extremity, which is necessary for healing of various types of leg and foot ulcers.

Figure 7:
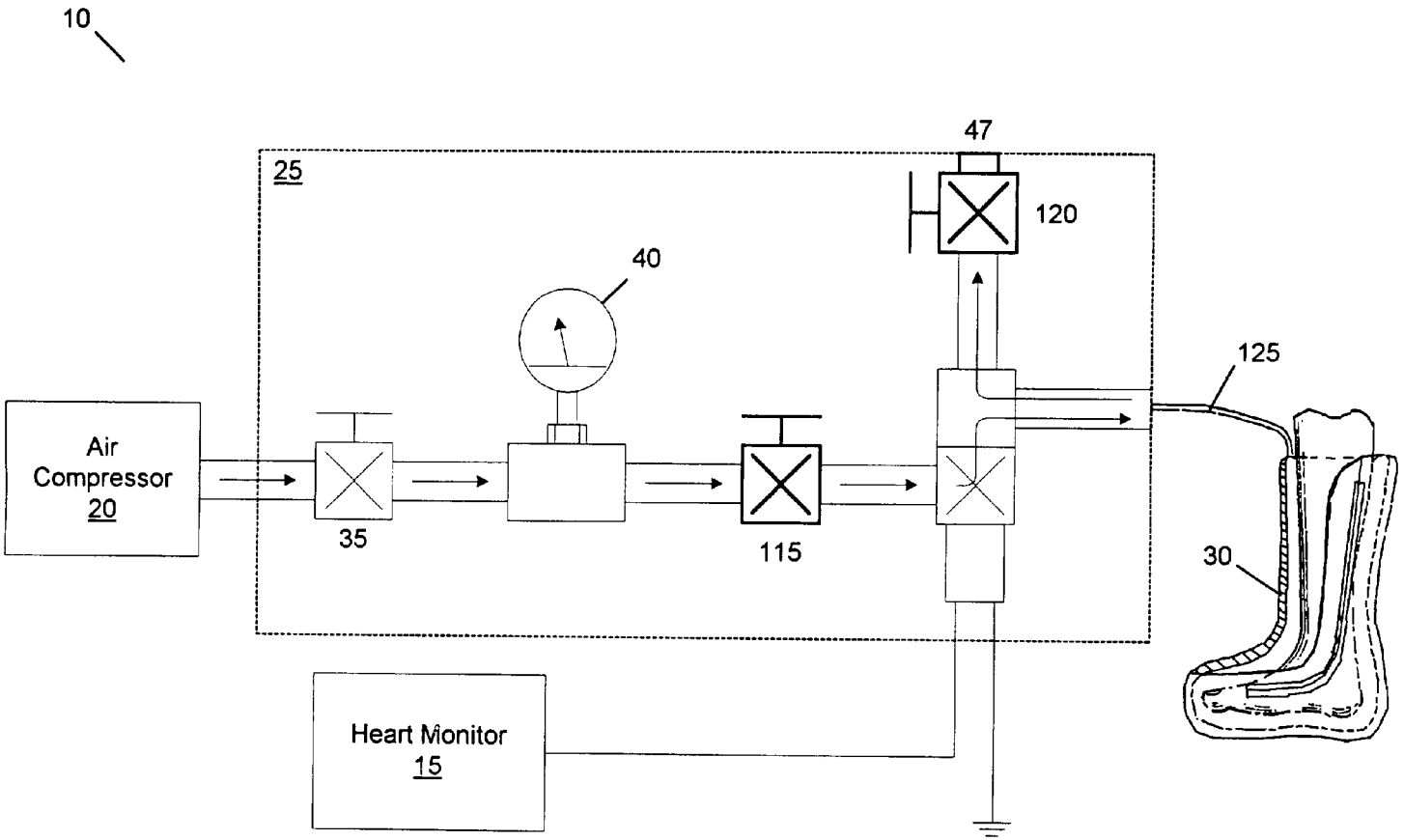
FIG. 7 is an alternative embodiment that includes the addition of two flow control valves to the peripheral circulation enhancement system.

An alternative embodiment is shown in FIG. 7. Two manually adjustable, pneumatic flow control valves are added, 115 and 120; one to the inlet port of the 3-port valve 45 and one added to the exhaust port 47. The addition of these two flow control valves allow precise and independent adjustment of the rate flow for pressurizing and exhausting the peripheral boot.

It should be understood that although the present invention is described in detail for its particular embodiments, there may be other variations and modifications that will become apparent to those who are skilled in the art upon reading this specification, and that these modifications or variations that can be made should not detract from the true spirit of this invention.

I claim:

1. A circulation enhancement system comprising:

a compression boot including a means for enhancing circulation of an extremity;

a compressed air source communicating with the compression boot via a pneumatic controller;

a heart monitor means for sensing a P segment and a U segment of a heart waveform pulse;

said heart monitor means is in communication with the controller through a solonoid operated pneumatic valve that is configured to open at the P segment and close at the U segment, thereby pressurizing the boot to empty the extremity of excess fluids; and wherein an electrical pulse created from the P segment is conducted by the heart monitor means to an amplifier whose output is connected to a pulse counter that includes a selector switch to select a number of heartbeats in a boot relaxation period, said selector switch connected to a set input of an RS flip-flop.

2. A circulation enhancement system in accordance with claim 1, the compressed air source having an oil-less and waterless air compressor for inflating the compression boot.

3. A circulation enhancement system in accordance with claim 1, the boot having an inner and an outer casing and a tube that connects the inner casing with an intake and an exhaust port of said pneumatic valve.

4. A circulation enhancement system in accordance with claim 3, wherein the inner casing is fabricated of a flexible material and the outer casing is more rigid than the inner casing for expansion of the inner casing against an extremity encased in the boot.

5. A circulation enhancement system in accordance with claim 4, wherein the controller is configured to initiate a compression cycle with an applied air pressure to the boot concurrent with the P segment.

6. A circulation enhancement system in accordance with claim 5, wherein the controller is configured to slowly increase the applied pressure to the boot while a back pressure from the heart is near its lowest point for compressing the extremity.

7. A circulation enhancement system in accordance with claim 6, wherein the controller is configured to exhaust the applied pressure to the boot concurrent with the U segment, thereby relieving compression of the extremity while anticipating the next compression cycle.

8. A circulation enhancement system in accordance with claim 7, the pneumatic controller having a controller box with an adjustable pneumatic pressure control valve to provide a desired air pressure to the compression boot.

9. A circulation enhancement system in accordance with claim 8, wherein the flip-flop is reset by an electrical pulse derived from a heartbeat's U segment that is outputted to an amplifier powering a solenoid associated with the solenoid operated pneumatic valve.

10. A circulation enhancement system in accordance with claim 9, the boot inner casing comprising an air-tight plasticized expandable bladder.

11. A circulation enhancement system in accordance with claim 10, wherein the boot outer casing is fabricated from a plastic material.

12. A circulation enhancement system in accordance with claim 11, wherein the compression cycle is initiated concurrent with the P segment and by attainment of a selected number of heartbeats.

13. A circulation enhancement system in accordance with claim 12, wherein a compression cycle is repeated at every other heartbeat.

14. A circulation enhancement system in accordance with claim 12, wherein the heart monitor means is preselected to count every second, or third or fourth heartbeat.

15. A circulation enhancement system in accordance with claim 12, wherein the boot includes a zipper with a zipped closure over an extremity to facilitate donning and removal of the boot.

16. A circulation enhancement system comprising:

a formed compression boot including a means for enhancing circulation;

a compressed air source communicating with the boot through a plastic tubing via a pneumatic controller having a solenoid operated 3-port pneumatic valve and an associated heart monitor;

wherein the pneumatic valve is alternately opened and closed by a signal derived from an EKG waveform and conditioned by the heart monitor to alternately commence and terminate a compression cycle of the boot; and the heart monitor comprising an EKG which provides a P segment pulse to an amplifier connected to a pulse counter with a rotary selector switch which connects to a set input of an RS flip-flop.

17. A circulation enhancement system in accordance with claim 16, wherein the EKG further provides a U segment pulse to an amplifier that is connected to a reset of the RS flip-flop.

18. A circulation enhancement system in accordance with claim 17, wherein an output of flip-flop connects to an input of a power amplifier which in turn powers the solenoid of the 3-port pneumatic valve.

19. A circulation enhancement system in accordance with claim 18, the compression boot further comprising a means for controlling expansion of the boot.

20. A circulation enhancement system in accordance with claim 19, wherein the boot includes an air-tight expandable inner lining within an essentially rigid outer lining and an air intake from the pneumatic valve that only expands the boot inner lining to a resistance of the rigid outer lining in a controlled expansion of the boot and a concomitant sequential compression of the extremity.

21. A circulation enhancement system in accordance with claim 20, said pneumatic controller including first and second flow regulators communicating with the compression boot via the 3-port pneumatic valve to allow precise and independent adjustment of the rate flow for pressurizing and exhausting the compression boot.

22. A peripheral enhancement system in accordance with claim 21, wherein the first regulator is configured to control a slow increase in a volume of air entering the compression boot, and the second regulator is configured to control a release of air entrapped within the compression boot.

23. A circulation enhancement system in accordance with claim 20, wherein the P segment pulse is amplified and provided via the pulse counter to the set input of the RS flip-flop to open the 3-port pneumatic valve and allow a volume of air into the boot, thereby filling the boot and creating a compression of the extremity encased in the boot.

24. A circulation enhancement system in accordance with claim 23, wherein the U segment pulse is amplified and emitted to the reset of the RS flip-flop to close the pneumatic valve, whereby a full boot compression is succeeded a slow decrease of an internal pressure of the boot with release of air entrapped therein to the ambient atmosphere concurrent with an initiation of said U segment pulse.

25. A circulation enhancement system in accordance with claim 24, wherein the heart monitor is manually preselected for a selected number of heartbeats and upon attaining the selected number of heartbeats the pneumatic controller initiates a compression cycle in the boot.

26. A circulation enhancement system in accordance with claim 25, wherein said heart monitor is configured to synchronize an air pressure of the boot to force an excess entrained fluid from an extremity commencing with said P segment.

27. A circulation enhancement system in accordance with claim 26, the boot having a zipper closable over an extremity which facilitates donning and removal of said boot.

28. A circulation enhancement system in accordance with claim 27, the selected number of heartbeats is chosen from a group consisting of every beat, every other beat, or a plurality of heartbeats.

29. A circulation enhancement system in accordance with claim 28, wherein the compressed air source comprises an oil-less and waterless air compressor, which can be set to produce up to 90 psi to operate and inflate the boot.

30. A circulation enhancement system in accordance with claim 29, wherein the compressed air source provides between 20 to 30 psi.

31. A method for enhancing circulation of an extremity, comprising the steps of:

a. encasing the extremity in a compression boot connected to a compressed air source;

b. attaching the heart monitor including an EKG to the patient;

c. sensing a P segment pulse from the EKG;

d. conducting the P segment by the heart monitor to an amplifier whose output is connected to a pulse counter that includes a selector switch for selecting a number of heartbeats in a boot relaxation period said selector switch connected to a set input of an RS flip flop;

e. compressing the extremity with compressed air from the air source into the boot concurrent with the P segment pulse;

f. sensing a U segment pulse from the EKG; and g. de-compressing the extremity by a release of compressed air from the boot commencing with said U segment pulse to enable blood flow into the extremity.

32. The method for enhancing circulation of an extremity of claim 31, further comprising the step of:

h. attaching a plastic tube from the boot to a 3-port pneumatic valve.

33. The method for enhancing circulation of an extremity of claim 32, wherein the sensing the P segment includes the step of:

i. setting a pulse counter to a desired number of heartbeats.

34. The method for enhancing circulation of an extremity in accordance with claim 33, wherein the compressing the extremity is achieved by:

j. expanding an inner membrane of the boot slowly around the extremity to empty the extremity of excess fluids.

35. The method for enhancing circulation of an extremity according to claim 34, further comprising the step of:

k. sending the P segment pulse a signal to a control box.

36. The method for enhancing circulation of an extremity according to claim 35, further comprising the steps of:

l. energizing a solenoid associated with the 3-port pneumatic valve; and m. opening an intake port of the 3-port pneumatic valve to inflate the inner membrane of the boot.

37. The method for enhancing circulation of an extremity in accordance with claim 36, further comprising the steps of:

n. energizing the solenoid; and o. opening an exhaust port of the 3-port pneumatic valve to exhaust air from the boot.

* * * * *